United States Patent [19]

McLeod

[11] Patent Number: 5,025,857

[45] Date of Patent: Jun. 25, 1991

[54] WELLHEAD TUBING AND CASING PACKER AND INSTALLATION AND REMOVAL TOOL

[76] Inventor: Roderick D. McLeod, 5104-125 St., Edmonton, Alberta, Canada, T6H 3V5

[21] Appl. No.: 260,071

[22] Filed: Oct. 20, 1988

[51] Int. Cl.[5] ..... F21B 19/00

[52] U.S. Cl. ..... 166/77; 166/80; 166/387

[58] Field of Search ..... 166/387, 80, 86, 87, 166/88, 96, 124, 181, 182

[56] References Cited

U.S. PATENT DOCUMENTS

| | | | |
|---|---|---|---|
| 1,984,230 | 12/1934 | Otis | 166/77 X |
| 3,108,630 | 10/1963 | Burns | 166/124 |
| 4,632,183 | 12/1986 | McLeod | 166/80 X |
| 4,657,075 | 4/1987 | McLeod | 166/72 |

FOREIGN PATENT DOCUMENTS 1094945 2/1981 Canada .

OTHER PUBLICATIONS

Guiberson Catalog pp. re: Tandem Tension Packer, Charger Drillable Bridge Plug, Seal Bore Packer Accessories.

Halliburton Catalog pp. re: Speed E Line Bridge Plug, EZ Drill Bridge Plug, Wire Line Setting Tool.

Baker Service Tools Catalog pp. re: Bridge Plugs, Specification Guide, Bridge Plugs, Retrievable Bridge Plugs.

*Primary Examiner*—William P. Neuder

*Attorney, Agent, or Firm*—Stevens, Davis, Miller & Mosher

[57] ABSTRACT

In the area of oilfield wellhead equipment, and specifically the wellhead valve known as the master valve on the wellhead array, there is often the necessity to remove this valve for repairs or for its replacement by some other piece of equipment such as a blow out preventer, this service being done while the well is under pressure from the fluids or gases normally being produced or for any other reason.

A novel packer is described which can be put into place in a section of the well tubing or casing close to the master valve using a novel tool which is also described. This packer will isolate the master valve from the well fluids and pressure, allow it to be taken off and replaced, or other equipment to be installed in its place, and also allow the master valve, its connections, or other equipment thus put on the well, to be pressure tested prior to removing the packer from the well tubing or casing and restoring the gas or fluid pressure to the wellhead array.

5 Claims, 5 Drawing Sheets

WELLHEAD TUBING AND CASING PACKER AND INSTALLATION AND REMOVAL TOOL

FIELD OF THE INVENTION

This invention relates to oil and gas well servicing and specifically to an apparatus to allow the master valve, or any such related equipment in the wellhead array of valves and fittings, to be removed while the well is under pressure from the well gas or fluid.

BACKGROUND OF THE INVENTION

Among the equipment and fittings usually found on the wellhead of an oil or gas well, there is a valve called the master valve. This valve will open or close the passage of fluids and gases in the well to any related equipment or piping above it, and is the last valve in a line of valves which control the flow of fluids or gases from the well. This valve develops leaks or otherwise becomes unserviceable over its lifetime and must be taken off to be repaired. The fluid or gases that are under pressure in the well must be plugged off in order to do this. For the explanations and descriptions which follow, we will use the word gas to mean both gases and fluids which may be in the well, and the word tubing to mean both tubing and casing. There are several ways to plug off the well, each with its own drawbacks. As examples, three such methods will be described. The first way is to 'kill' the well by pumping a fluid down the well, which fluid is of such a density that it will counterbalance the pressure from the producing formation and create a zero pressure at the master valve. The valve can then be removed. There is a risk in this method, as a well that has been 'killed' may not always come back into production when the counterbalancing fluid has been removed. A second method is to install a packer in the tubing. To do this, a mobile service rig is driven over the wellhead, and a packer run into the well on a length of steel pipe, through appropriate sealing mechanisms above the master valve, and set in place by rotating and loading weight or pulling up. The steel pipe is then unlatched from the packer, taken out of the well and the master valve may be removed. When the master valve or other equipment has bee replaced, the service rig runs in the steel pipe again, latches onto the packer, undoes the packer by rotating, loading weight or pulling, and removes it from the well. The disadvantages of this method are mainly financial, as the service rig is a large piece of mobile equipment which takes several people to run. A third method is to freeze off the wellhead. In this method, a heavy gel, about the consistency of tooth paste, is pumped through the master valve into the tubing for a short length below the master valve. Then around the outside of this area of the tubing, under appropriate insulation, liquid nitrogen is circulated in a coil and the resulting cooling freezes the gel in the tubing, thus effectively plugging the well. The master valve can then be removed and replaced. This method has its own inherent problems and dangers due to the number of variables encountered.

SUMMARY OF THE INVENTION

The present invention provides significant improvements in the art of downhole tubing packers used for packing off wells when the master valve is being removed as it provides an apparatus that can be put in place and operated by a single man with a small hoist truck in place of the usual well servicing rig and crew.

This is due to the small size of the invention. It will not replace the service rigs and wireline units for jobs needing packers placed more than several feet down the tubing. However, the use of this invention will allow the pressure testing of any equipment put on the wellhead using only a small amount of fluid or gas as the packer is installed only a few feet from the top of the well.

According to a broad aspect, the invention relates to a packer sized to fit the tubing in the well and an installation and retrieval tool. On the tool, the packer is attached in a removable way to a mandrel, which mandrel is moveable axially through a sealing adapter mounted on the master valve, this movement being actuated by either hydraulic cylinders or screwjacks connected between the top of the mandrel and the sealing adapter. For this description, we will use hydraulic cylinders, but will note here that screwjacks may also be used. The controlling mechanisms for setting and locking the packer, which mechanisms are inside the packer, are actuated by removeable wrenching rods which reach down to operate the mechanisms through the mandrel. The tool and packer are first installed on the closed master valve. The master valve is opened. The packer is moved through the opened master valve and to the place in the tubing where it is to be set, by the action of the hydraulic cylinders. The first wrenching rod is used to set the packer teeth to hold the packer body in place in the tubing. The expansion of the packer rubber is done by utilizing downward force from the hydraulic cylinders. The expanded rubber of the packer is locked in place by the second wrenching rod. The hydraulic cylinders will now be used to exert an upward pull to confirm that the packer teeth will hold the packer body in place. When these operations have been done, the packer is set and packed. The packer rubber seating is checked for pressure leakage from the well by opening a valve in the sealing adapter. If no gas leakage is noted, the mandrel is backed off of the packer and withdrawn from the tubing and through the master valve. The installation tool may now be taken off of the master valve and the master valve removed from the wellhead. To extract the packer from the tubing when the master valve or other equipment has been put in place, the tool is again installed on the master valve, the mandrel moved through the open valve and down to the packer and the mandrel rotatingly threaded on to the packer. If it is required to pressure test the wellhead equipment, fluid can be pumped into the valve on the sealing adapter. As the packer will seal in both directions, pressure will build up and any leaks in the wellhead equipment will be detected. When this test pressure is released, the wrenching rods are used to retract the packer rubber and unseat the packer teeth. The packer is now withdrawn through the tubing and master valve, the master valve is closed and the tool and packer taken off.

BRIEF DESCRIPTION OF THE DRAWINGS

The invention is illustrated by way of example only in the accompanying drawings in which:

FIG. 1 is a cross sectional schematic view of the invention, both tool and packer.

DESCRIPTION OF THE PREFERRED EMBODIMENT

Figure 1A:
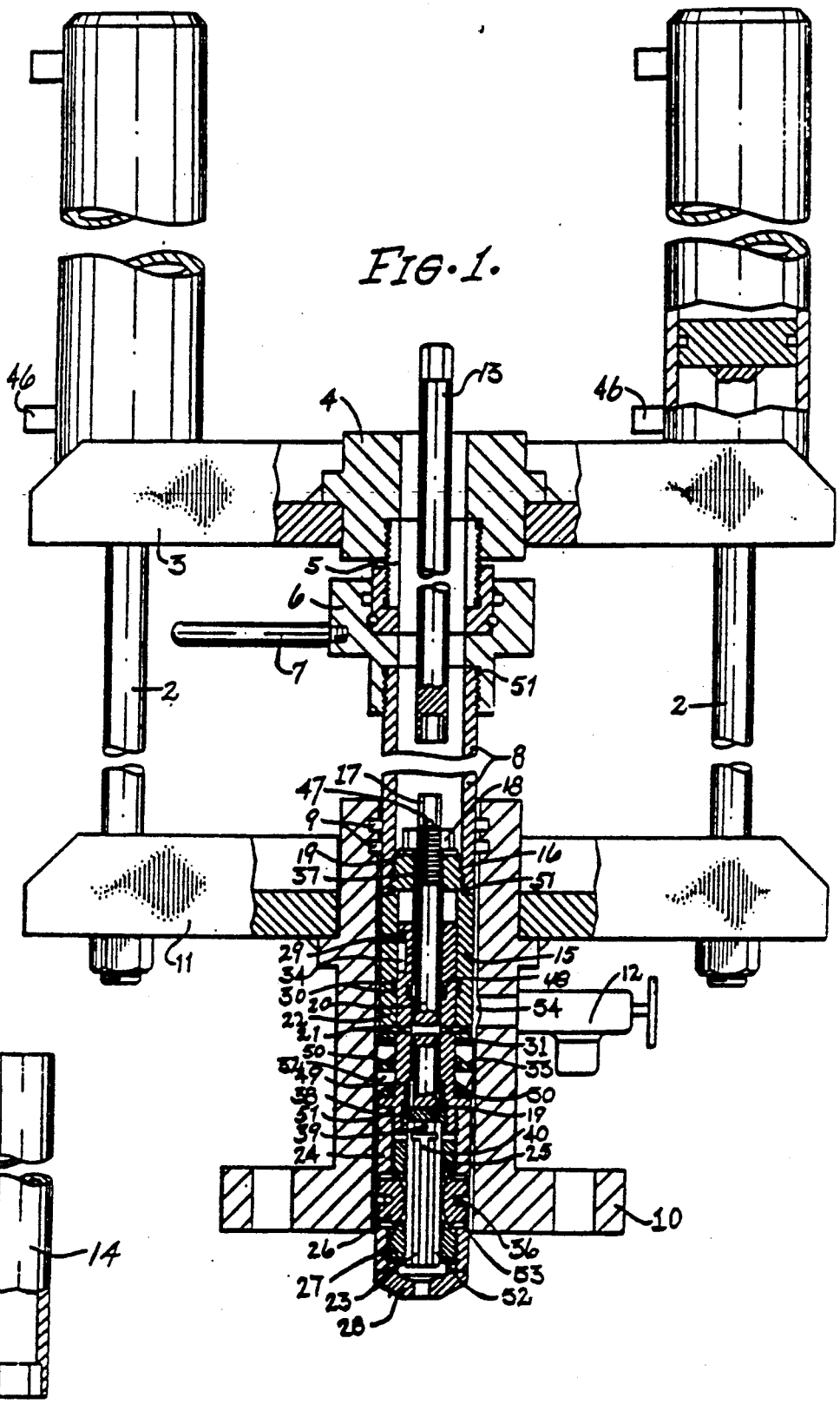
FIG. 1A is a fragmented elevation view, partly in section, of a packer wrench.

Referring to FIG. 1, the tool illustrated generally at 34 includes two hydraulic cylinders 1 which have the cylinder ends affixed to an upper beam 3 and the rod ends 2 fixed to a lower beam 11. Centrally located and fastened into the upper beam is the upper flanged body 4 into which is threaded the upper mandrel 5 to which threads into the rotary joint 6 with the rotating handle 7 attached to the lower end of the rotary joint. Into this lower end of the rotary joint is threaded the mandrel 8, which has an internal backoff-pickup thread at its lower end, which mandrel runs through the packing 9 in the sealing adapter 10 which adapter is centrally located and fastened into the lower beam. A valve 12 vents the bore of the sealing adapter to atmosphere. The majority of the parts of the tool are manufactured from various grades of steel.

The packer illustrated generally at 35 is held onto the mandrel by the backoff-pickup thread 16 which includes the seal 51 and which thread is part of the upper body 15. Into the upper body is fitted the inside body 22 and it is held in place in a solid way by the shear pins 21 and in a nonrotating way by the set screw 29 which acts in the slot 34 which is machined in the inside body. Seals at points 30 complete this assembly. The lower body 24 is threadingly attached to the inside body at 51 and has inside it an upper right hand threaded cone 25 and a lower left hand threaded cone 27. An inside feature of these cones is a six sided hole 52. Between these cones are radially spaced sets of teeth blocks 26 which are held inside slots in the body 53 by virtue of their shape, but can extend a short distance outside the body when forced out by the inward movement of the cones. The inside surface of the teeth blocks which engage the cones has a slight rounding to allow the teeth blocks to align themselves exactly with the tubing wall when they are activated. The shape of the teeth on the blocks and the geometry of the blocks allows the teeth to grip the tubing whether the force on the packer comes from above or below. The radial sets of teeth are also restrained inwards by the circumferential spring 36. The bottom of the lower body is terminated by the guide cone 28. Through the middle of the upper body and inside body runs the teeth actuating drive shaft 20. This shaft has a square top 17, a threaded portion 37, a bottom drive socket 38 and is held in place in the assembly with thrust bearing 19 and packing nut 18. The packing nut is free to run down the threads, but cannot come off the shaft due to the pin 47. The shaft is also acted on by the seals at 48 and 49. Into the socket at the end of the teeth actuator drive shaft is fitted the six sided teeth actuator shaft 23 held in this position by the pin 39. This shaft extends through and engages the six sided hole inside the cones. A pressure relief slot 40 is cut in this shaft. Fitted around the inside body are the rubber seals 32, the backup washer 31 and the expander rings 33. There are also the seals 50.

Figure 2:
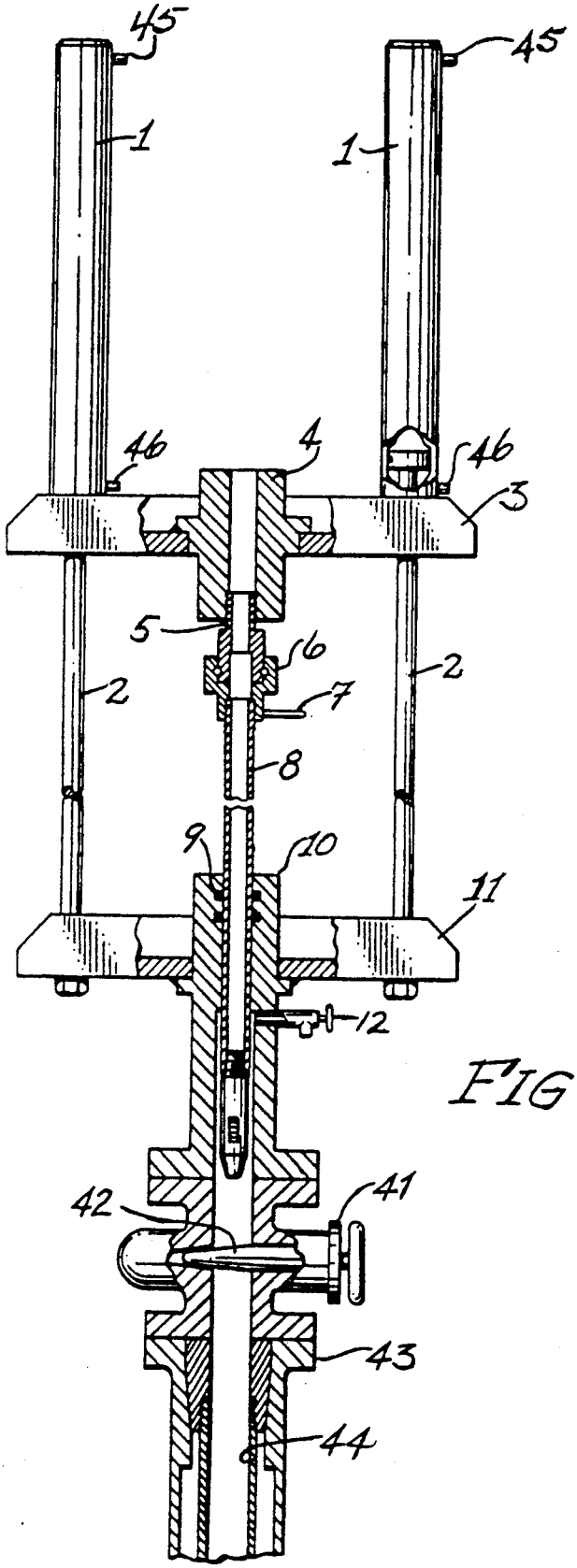
FIG. 2 is a partial cross sectional schematic view of the invention installed on the closed master valve of a well, prior to the actuation of the cylinders.
Figure 3:
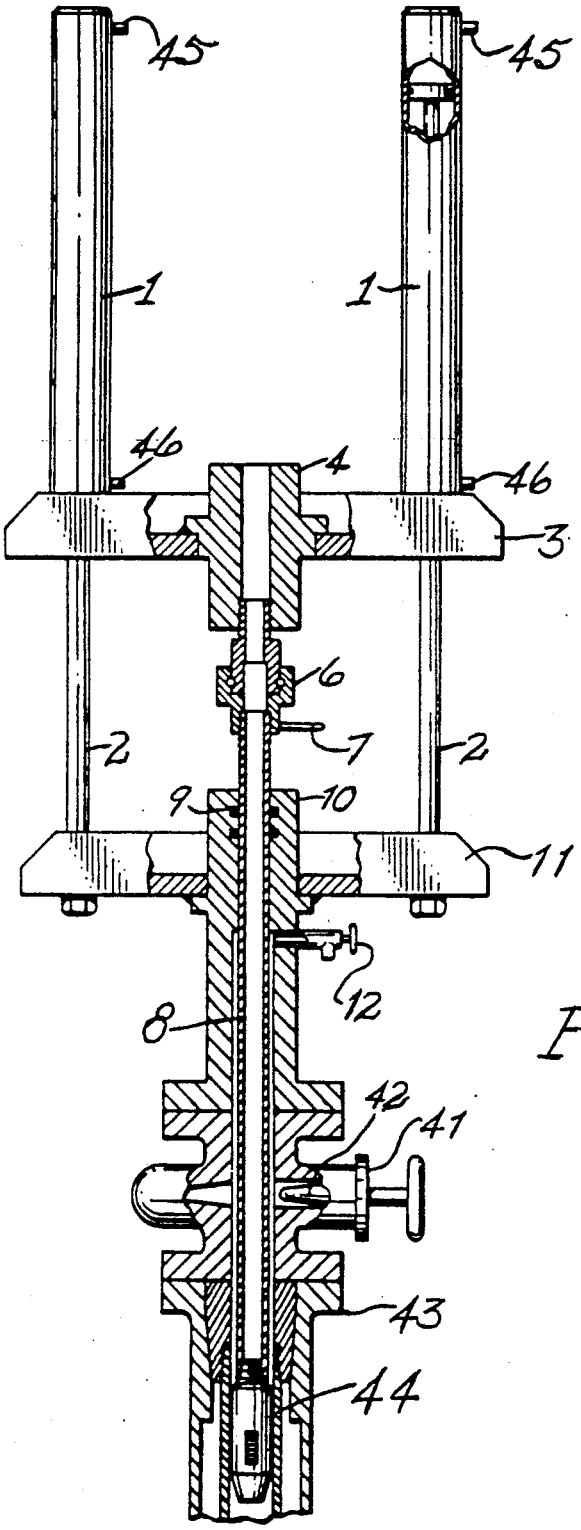
FIG. 3 is a partial cross sectional schematic view of the invention where the tool has run the packer into the tubing.
Figure 5:
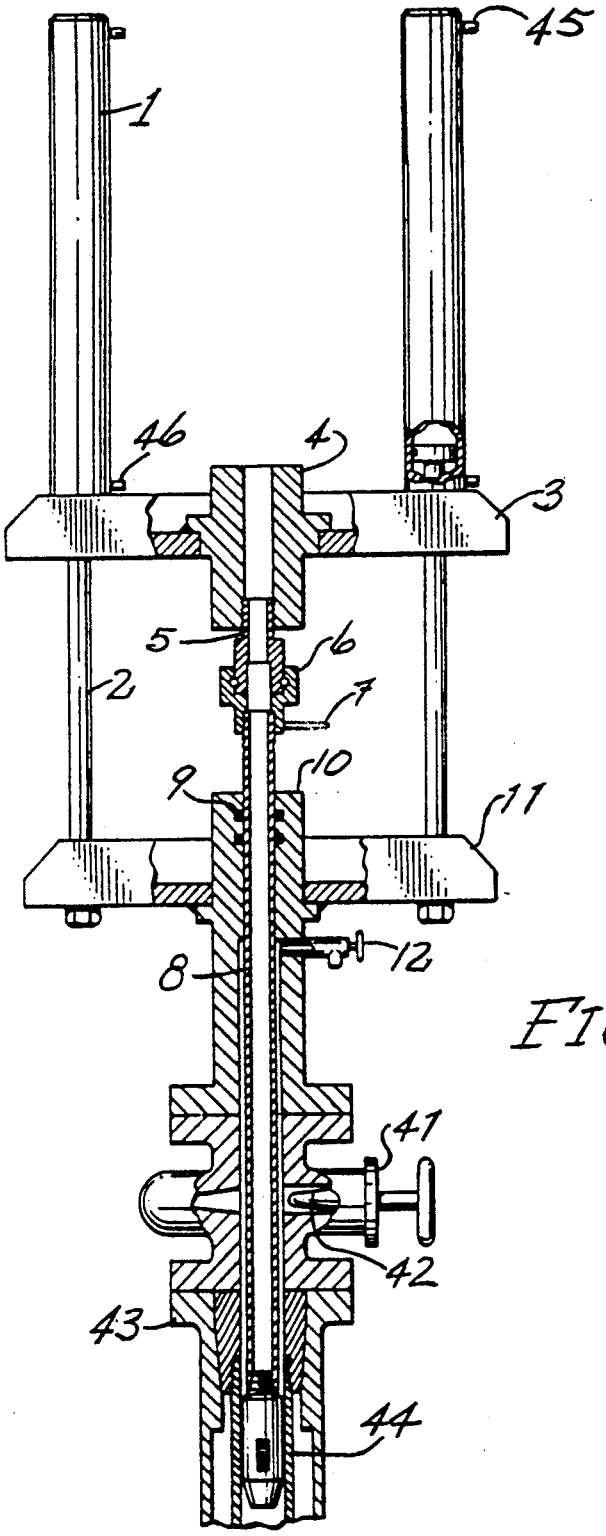
FIG. 5 is a cross sectional schematic of the tool and packer with the teeth actuated and the packer rubber expanded and locked and the mandrel of the tool ready to be backed off.

The invention is shown in FIG. 2 installed on a master valve 41 with its gate 42 in the closed position, the valve being mounted on the wellhead flange 43 which contains the apparatus for holding and sealing the tubing 44. Gases from the well will be coming up the tubing bore under pressure. It can be seen that when the valve gate is opened, no gases can escape to atmosphere due to the various seals in the invention. It will also be seen that in response to hydraulic fluid from an outside source being fed into the cylinder fittings at 46, the upper beam with the mandrel secured in it will move downward toward the lower beam, thus moving the packer through the opened master valve and down into a position in the tubing as shown in FIG. 3. The packer is now ready to be set. Referring also to FIG. 1, the teeth setting wrench 13 is manually placed into the mandrel and engages the square on the teeth actuating drive. This shaft is now turned, causing the attached six sided teeth actuating shaft to rotate in a direction which will cause the upper and lower cones to move together, as they have right and left hand threads. The teeth blocks will now be forced outward against the tension of the circumferential spring to engage the wall of the tubing and dig into it. This is shown in FIG. 5. The lower body and the threadingly attached inner body are now restrained from moving in the tubing, a force in either direction actually pushing the teeth further into the tubing wall. In order to check the holding power of the teeth, fluid may be pumped into the fittings at 45 on the cylinders and this will cause the tool to pull up on the packer. The amount of pull will be known by reading a pressure gauge in the external hydraulic system. The teeth setting wrench is now removed from inside the mandrel.

Figure 4:
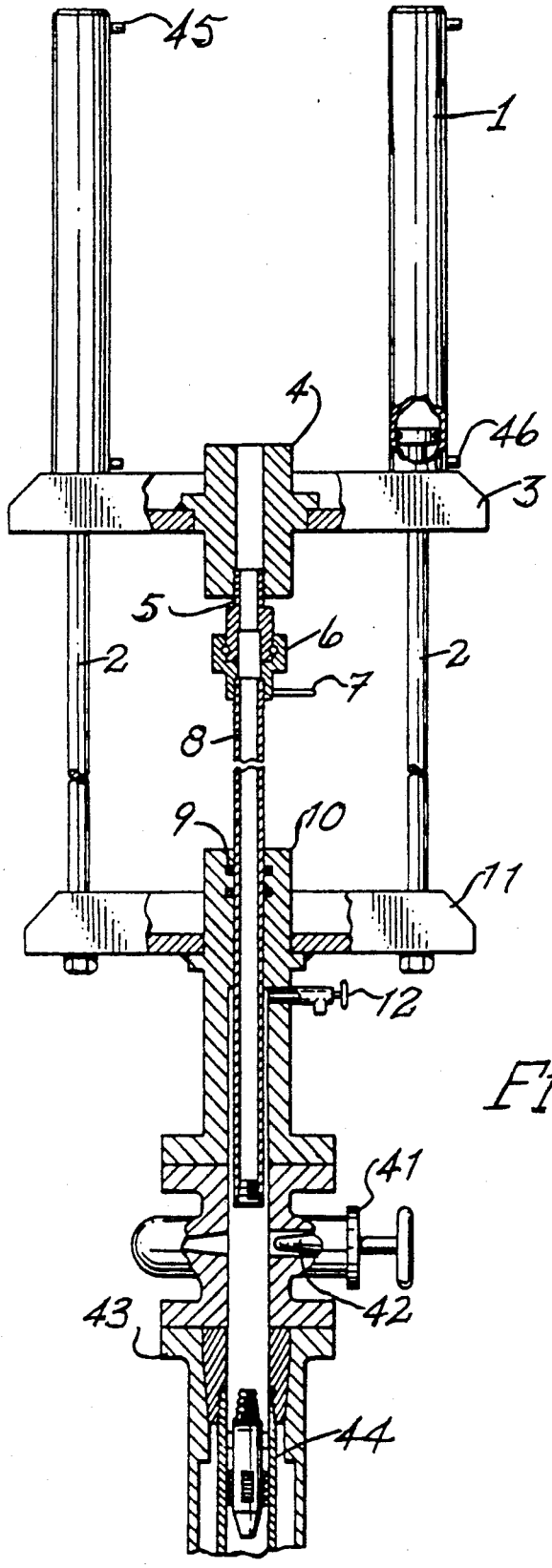
FIG. 4 is a partial cross sectional schematic view of the packer left in the tubing and the tool retracted out of the master valve.

The rubber seals on the packer are set in the following fashion. Hydraulic fluid is pumped into the fittings 46 on the cylinders and the mandrel and thus the upper body is forced down against the lower body and inner body which are locked in place in the tubing. The shear pins 21 shear and allow the upper body to move down relative to the inside body to compress the rubber seals and force them out into contact with the tubing wall by the action of the seal expanders. When a pre-calculated movement of the mandrel or a known hydraulic pressure has been reached, the valve in the sealing adapter may be opened to confirm that the rubber seals have been compressed and are sealing against the tubing, thus sealing off the well pressure. While the upper body was moving down with respect to the rest of the packer, the teeth actuating drive shaft remained in its set position, and the shoulder at the top of the backoff-pickup thread which the packer nut had been held against, moved away from the nut. The packer wrench 14 is now put into the mandrel and engages the packer nut. The nut is now turned downwards until it once again runs into the shoulder on the backoff-pickup thread. This locks the upper body and the inside body together, and holds the rubber seals in their compressed sealing state against the tubing wall. The open valve in the sealing adapter will confirm the seal is still holding. The tool and packer are now ready to be disengaged. Now the cylinder fittings at 45 and 46 are opened to the atmosphere and the rotating handle 7 is turned in such a direction that the backoff-pickup thread comes undone. It will be seen that the mandrel will move upwards the length of this thread engagement. When the thread is disengaged, hydraulic fluid is introduced into the cylinders at 45, and the mandrel moved out of the tubing and back through the master valve. This position is shown in FIG. 4. The tool may now be taken off the master valve and the master valve may be taken off the well head flange. The packer is now holding back the well pressure.

When it is desired to remove the packer from the tubing, this procedure is followed. The master valve or any other equipment has been installed on the wellhead flange. The tool is installed on the master valve as in FIG. 4. Hydraulic fluid is fed into the cylinders at 46, moving the mandrel down until the female thread in the mandrel engages the male backoff-pickup thread. This point will be noted by a rise in the hydraulic pressure noted on the gauge. The rotating handle is now turned in a direction which will engage the backoff-pickup thread and run the thread together. The mandrel will move downward, being loaded slightly from time to time by the hydraulic system. When the thread has been fully engaged and a known torque put on the rotating handle, the packer is fully attached to the mandrel and is ready to be unsealed and unseated. It may be desired first to check the seals in all the equipment above the packer. To do this the cylinders are first locked hydraulically by closing the ports 45 and 46. Fluid under pressure from an outside source is now pumped through the valve 12 and will fill all the cavities above the packer 54 and due to the two direction sealing of the packer seals, will build up pressure and show any leaks in the seals of the newly installed equipment. After the test has been done, the pressure is released, and the valve 12 closed. The packer wrench is now put in the mandrel and engages the packer nut. The cylinders are used to exert a small downward force on the rubber seals and thus take off the pressure between the nut and the shoulder and the nut is then rotated in a direction away from the shoulder until it engages the pin 47. The hydraulic pressure in the cylinders is now released and the pressure on the rubber seals is thus taken off. The mandrel may have to be moved upwards by use of the cylinders to move the upper body up to once again engage the packer nut against the shoulder. The packer rubber seals are no longer sealing the well pressure. The hydraulic cylinders will now be locked hydraulically by closing ports 45 and 46. Continued rotation of the packer nut which is now up against the stop pin, will now rotate the teeth actuating shaft and cause the cones to move apart and thus allow the teeth to disengage from the tubing wall and be pulled in by the circumferential spring. When they have been fully retracted, the mandrel with the packer attached may be allowed to move out of the tubing and up through the master valve by action of the cylinders and also aided by the pressure in the well. When the packer has moved through the master valve, the valve is closed, any pressure above the master valve is bled off by opening the valve 12 and the tool and packer are removed from the master valve.

Those skilled in the art will appreciate that various features, characteristics and advantages of the present invention have been set forth herein or are readily realizable from the detailed description of the preferred embodiment. However, the disclosure is illustrative and various changes may be made while utilizing the principles of the present invention and falling within the scope of the invention as expressed in the appended claims.

The embodiments of the invention in which an exclusive property or privilege is claimed are defined as follows:

1. Apparatus for removing a wellhead fitting while a well is under pressure, said apparatus comprising:

(a) a packer sized to fit tubing in said well; and (b) tool means for installing and retrieving said packer in said tubing;

said tool means comprising (i) a lower tubular body adapted for mounting on said fitting; (ii) first lower beam means mounted on said lower body; (iii) second, upper beam means interconnected with said first beam means for reciprocal movement toward and away therefrom; (iv) an upper flanged body having a through bore mounted in said second, upper beam, said upper flanged body being in axial alignment with said lower tubular body and including thereon a threaded upper mandrel connecting means; (v) a rotatable joint connected to said upper mandrel and including means for suspending a lower mandrel, and means for rotating said rotatable joint; (vi) sealing means in said lower tubular body for circumferentially sealing said lower mandrel passing therethrough; (vii) said packer being removable attached to the lower end of said lower mandrel and (viii) means for insertion through said upper body in said first beam means and said mandrels for engaging, setting and locking said packer in said well tubing.

2. Apparatus according to claim 1 wherein said packer has means to enable it to be activated either by a rotary motion applied through said mandrel or by vertical movement applied by interaction of said upper and lower beam members.

3. Apparatus according to claim 1 wherein said packer includes a set of radially extendable teeth for engaging the inner wall of said tubing and resilient sealing means on said packer for expansion within said tubing to seal pressures therein.

4. Apparatus according to claim 3 wherein said packer includes a threaded upper portion for engagement with and disengagement from said mandrel and a central bore in said threaded upper portion for receiving operating tool means for setting or releasing said packer from said tubing.

5. Apparatus according to claim 3 wherein said packer includes upper and lower cone means, above and below said teeth respectively and wherein movement of said cones with respect to one another effects radial movement of said tubing-engaging teeth, said cones being activated by rotating wrench means inserted downwardly through said mandrel and packer and operable from the exterior thereof; and means for expanding the resilient sealing means.

* * * * *